US010166669B1

(12) United States Patent
Kowalski

(10) Patent No.: US 10,166,669 B1
(45) Date of Patent: Jan. 1, 2019

(54) EXTENDABLE AND RETRACTABLE WRENCH

(71) Applicant: Adam W. Kowalski, Schaumburg, IL (US)

(72) Inventor: Adam W. Kowalski, Schaumburg, IL (US)

( * ) Notice: Subject to any disclaimer, the term of this patent is extended or adjusted under 35 U.S.C. 154(b) by 167 days.

(21) Appl. No.: 15/290,066

(22) Filed: Oct. 11, 2016

(51) Int. Cl.

| | |
|---|---|
| ***B25G 1/04*** | (2006.01) |
| ***B25B 13/48*** | (2006.01) |
| ***B25G 1/10*** | (2006.01) |
| ***B25B 13/50*** | (2006.01) |

(52) U.S. Cl.
CPC ..... *B25G 1/043* (2013.01); *B25B 13/481* (2013.01); *B25B 13/50* (2013.01); *B25G 1/105* (2013.01)

(58) Field of Classification Search
CPC ..... B25G 1/043; B25G 1/105; B25B 13/50; B25B 13/5025; B25B 13/5058; B25B 13/481
USPC ..... 81/177.2, 166, 167, 169, 170
See application file for complete search history.

(56) References Cited

U.S. PATENT DOCUMENTS 2,350,097 A * 5/1944 Conner ..... B25F 1/003 254/25
2,652,736 A * 9/1953 Kiene ..... B25G 1/00 16/427
4,409,866 A * 10/1983 McBride ..... B25G 1/04 16/429
5,285,702 A * 2/1994 Hillinger ..... B25G 1/043 16/429
6,131,490 A * 10/2000 Lee ..... B25B 13/461 81/177.2
6,182,539 B1 * 2/2001 Webster ..... B25B 23/0021 81/177.2
7,059,221 B2 * 6/2006 Simon ..... B25B 13/04 81/164
7,472,630 B1 * 1/2009 Velluzzi ..... B25B 13/16 81/177.2
8,176,816 B2 * 5/2012 Simon ..... B25B 13/04 81/165
8,684,620 B2 * 4/2014 Lin ..... B25G 1/04 16/429
2004/0025649 A1 * 2/2004 Rugee ..... B25G 1/043 81/177.2
2013/0098212 A1 * 4/2013 Ingersoll ..... B25G 1/043 81/177.2
2014/0102263 A1 * 4/2014 Reichlin ..... B25G 1/043 81/177.2
2015/0360351 A1 * 12/2015 Harvey ..... B25B 13/5058 81/167

* cited by examiner

*Primary Examiner* — David B Thomas
(74) *Attorney, Agent, or Firm* — Dillis V. Allen, Esq.

(57) ABSTRACT

An extendable and retractable handle pipe wrench, particularly for drain clean-outs, where the handle sections are reinforced to increase wrench torque capacity with additional technology and where at least one of the handle sections is separable to reduce the overall handle length in tight quarters.

8 Claims, 3 Drawing Sheets

EXTENDABLE AND RETRACTABLE WRENCH

BACKGROUND OF THE INVENTION

Variable length wrenches have been devised to change the torque capacity of the wrench, but have not found significant success in the opening and closing of sewer clean-out, plugs which specifically have a nut size of about 1 ⅞ inches. The problem in unscrewing these clean-out plugs is they tend to bind up over time due to seal material and age. It is common for these plugs to require an extender such as a metal tube to slide over the handles of the standard pipe wrench to achieve and supply the torque a human operator can apply to the sticking clean-out plug nut.

In many cases these plugs are located in basement or outdoor locations where such handle extensions can be utilized with sufficient space. There are, however, instances or locations where such tube extenders cannot be used due to adjacent structures such as walls or piping. To accommodate these tight locations, this present outer section is axially separable into two sub-sections so one sub-section can be laid aside and the other remains on the wrench handle to significantly reduce the retracted length of the wrench handle for tight situations.

The following references have been found in a preliminary search of this product:

Stoops, U.S. Pat. No. 4,104,935, issued Aug. 8, 1978

Holloway, Jr., U.S. Pat. No. 4,729,281, issued Mar. 8, 1988

Ball, U.S. Pat. No. 4,738,167, issued Apr. 19, 1988

Hedden, U.S. Pat. No. 5,216,940, issued Jun. 8, 1993

Baker, U.S. Pat. No. 5,396,820, issued Mar. 14, 1995

Tsai, U.S. Pat. No. 6,405,396, issued Jun. 18, 2002

Foster, U.S. Pat. No. 6,959,465, issued Nov. 1, 2005

Picone, U.S. Pat. No. 7,114,824, issued Oct. 3, 2006

Hsien, U.S. Pat. No. 7,178,431, issued Feb. 20, 2007

Lin, U.S. Pat. No. 7,878,094, issued Feb. 1, 2011

Cheng, U.S. Pat. No. 9,248,554, issued Feb. 2, 2016

Hernandez, Jr., U.S. Pat. No. 9,266,232, issued Feb. 23, 2016

In addition to the above United States Patents, the following web sites are also relevant:

Web Sites: http//:/jet.com—4/1/2016;

www.aliexpress.com—3/19/2016 www.ecsi4gas.com—3/19/2016 https:/sites.google.com/site/brucekcampbell/ home/pipe-wrench-handle-extender—3/19/2016

Particular attention should be directed to the tools shown in the ⅜" Extendable Ratchet Handle intending Extension Wrench in jet.com/product/detail.

It is a primary object of the present invention to ameliorate the problems noted about in pipe wrenches.

SUMMARY OF THE PRESENT INVENTION

According to the present invention, an extendable and retractable handle pipe wrench is provided, particularly for drain clean-outs, where the handle sections are reinforced to increase wrench torque capacity with additional technology and where at least one of the tube sections is separable to reduce the overall handle length in tight quarters. The pipe wrench can also be useful for untying nuts and bolts.

Toward these ends, both the outer tube section and the inner tube section include interengaging tube assemblies with the outer tube section being the distal one related to the pipe wrench jaws, and the outer section assembly including a reinforcing tube fixed in the outer tube assembly that slides within the inner tube assembly for the reinforcing effect.

Also, the separation of the outer section into two separable sub-sections is achieved with easy or quick disconnect threaded connectors in the outer tube assembly and the inner tube assembly that the operator disconnects and reattaches by twisting portions of the outer tube assembly.

DETAILED DESCRIPTION OF THE PREFERRED EMBODIMENT

Figure 1:
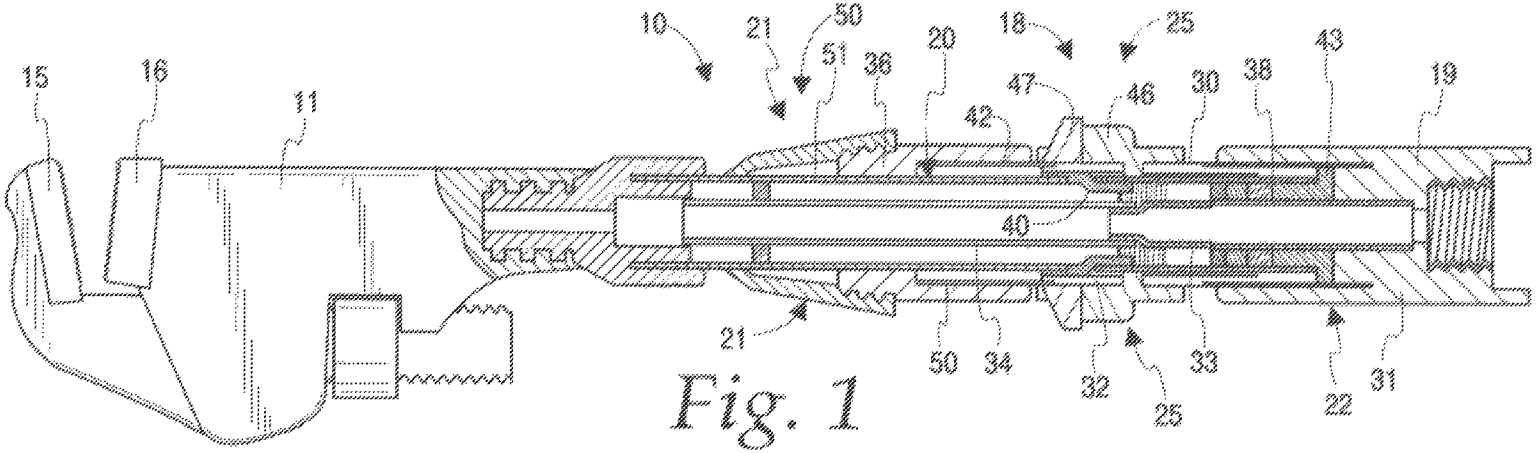
FIG. 1 is a plan view, partly in cross section of the present extendable and retractable wrench assembly 10.
Figure 2:
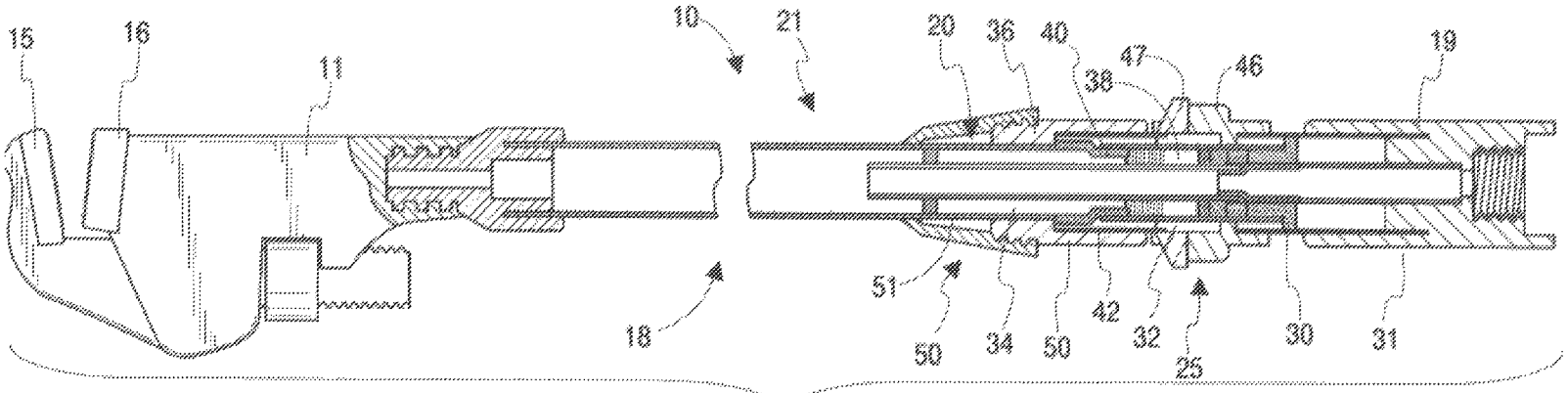
FIG. 2 is a plan view similar to FIG. 1, with the present extendable and retractable wrench assembly 10 shown in its extended position.

Referring to the drawings, and particularly FIGS. 1 and 2, the present extendable and retractable wrench assembly 10 is shown illustrated partly in axial section that includes a pipe wrench head 11 having jaws 15 and 16, handle assembly 18 with an outer base section 19 and an inner extendable inner tube assembly 20, slidable in the base outer tube assembly 19. The extendable and retractable wrench assembly 10 is shown illustrated in its retracted position in FIG. 1, and its extended position in FIG. 2. The handle assembly base outer assembly 19 is disconnectable in two sub-sections 21 and 22 with a quick disconnect assembly 25.

The outer telescopic handle section 19 includes a distal tube section 30 fixedly mounted in an annular seat 31 and a proximal tube section 42 releasably connected together by a threaded sleeve 32.

The inner tube assembly 20 is clamped in its axially adjusted position to the outer tube assembly by a clamping assembly 50.

A reinforcing tube 33 is fixed in seat 31 and it has a coaxial second tube section 34 slidable in inner tube section 20 for the purpose of reinforcing both the inner tube 20 and the outer tube section 19.

The inner tube assembly 20 includes a proximal tube section 37 and a distal tube section 38 releasably connected to one another by a stepped dual threaded sleeve 40, which is part of the quick disconnect assembly 18.

The inner tube assembly 20 also includes a seat assembly 43 slidable in the outer tube section 30.

The reinforcing tube sections 33 and 34 have a threaded stepped interconnection at 44 that permits the disconnection of the reinforcing tube section 34 from the reinforcing tube section 33, and this threaded inner connection is part of the quick disconnect assembly 25.

Figure 4:
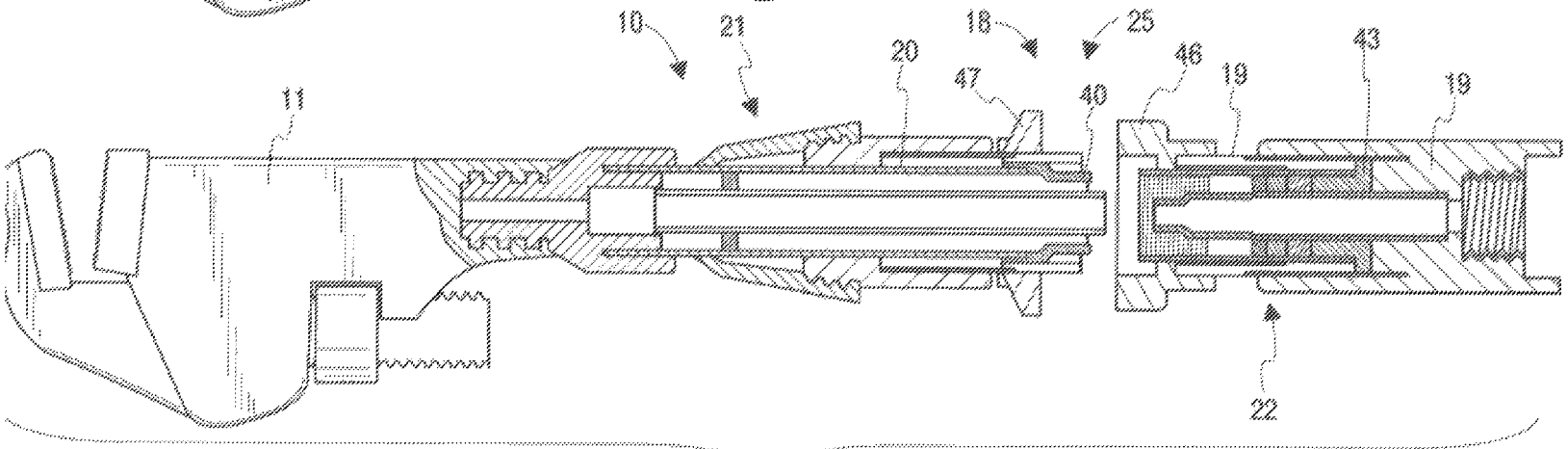
FIG. 4 is a plan view, partly in section of the present extendable and retractable wrench assembly similar to FIGS. 1 and 3, with the base section disconnected into two sub-sections.
Figure 5:
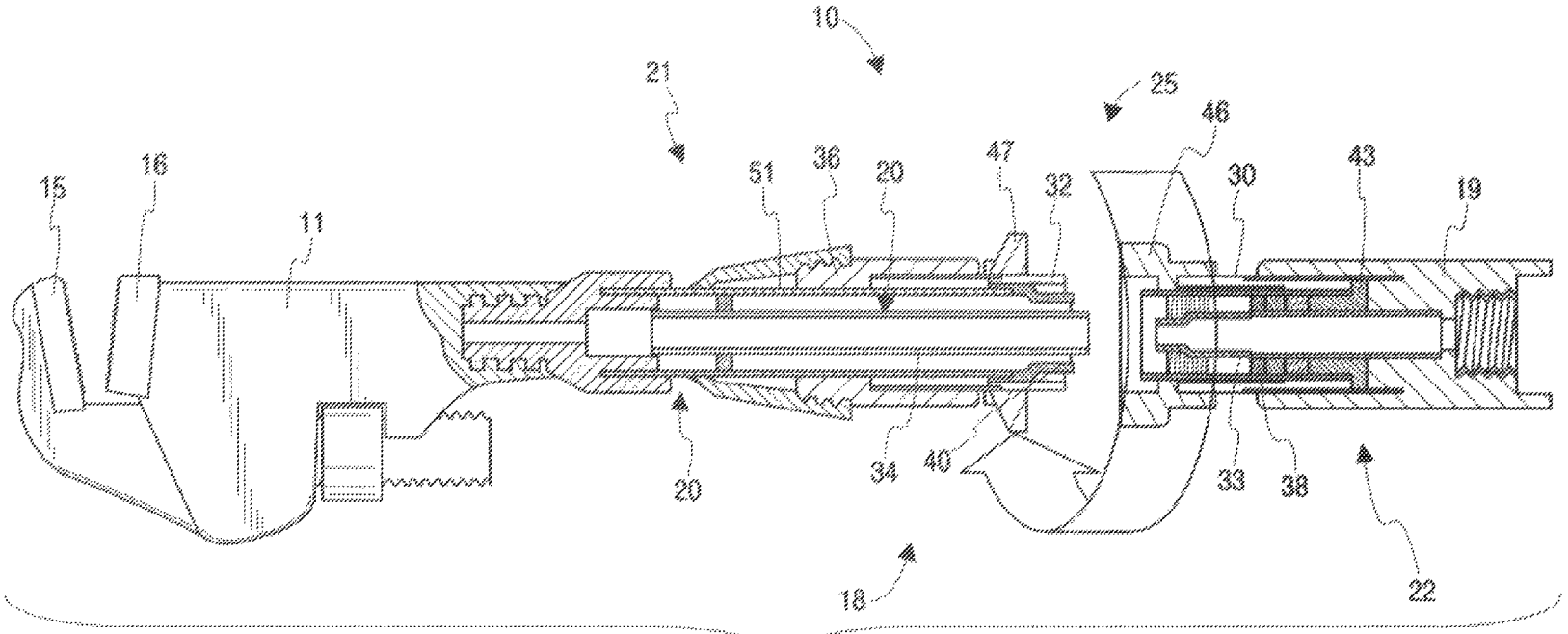
FIG. 5 is a plan view, partly in section of the present extendable and retractable wrench assembly 10 with the base sub-sections disconnected showing the twisting disconnect of the base section.

The quick disconnect assembly 25 also includes a nut portion 46 fixed to the outer assembly tube 30 and a second annular nut portion 47 fixed to the outer tube section 42 so that upon rotation of nut section 46 with respect to rotation of the nut portion 47, both the reinforcing tube sections 33 and 34 disconnect from one another as seen in FIGS. 4 and 5, and the outer tube sections 30 and 42 disconnect from one another by disconnecting the threaded sleeve 32, and the inner rube assembly 20 disconnects by separating inner tube section 38 from inner tube section 37 by releasing stepped threaded sleeve 40.

Figure 3:
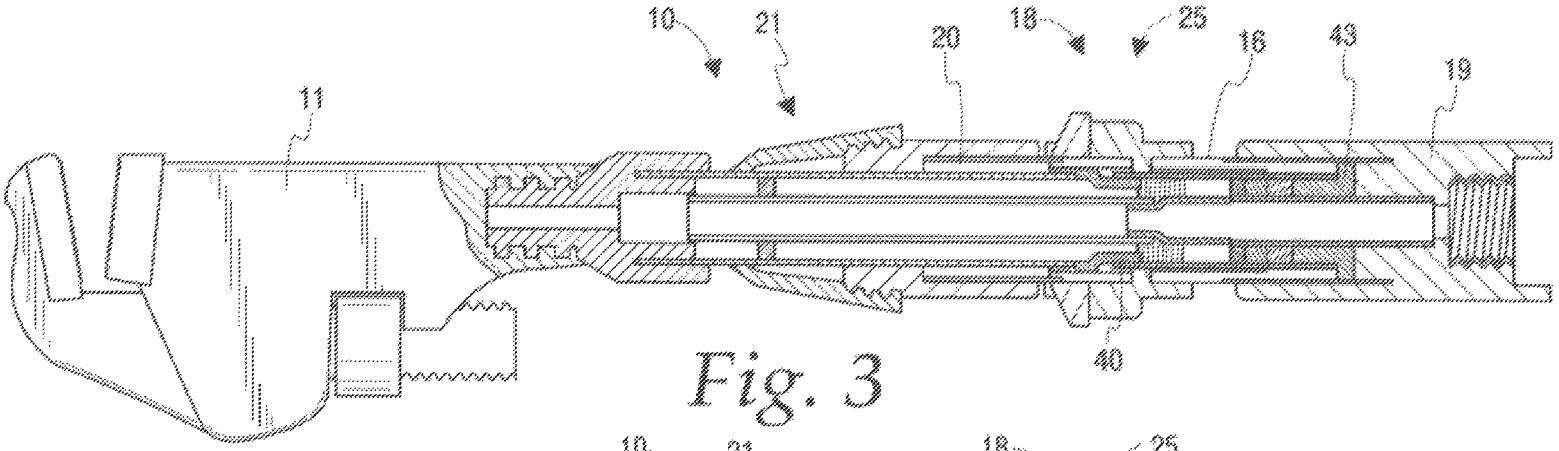
FIG. 3 is a plan view of the present extendable and retractable wrench assembly, partly in cross section with the sub-sections of the base section connected.

It should be noted that the quick disconnect assembly 25 is operable in the retracted position of the assembly 10 shown in FIGS. 1 and 3.

The outer tube section 19 and the inner tube section 20 are locked with respect to each other by a rotating nut assembly 50 that has split fingers 51 to clamp against inner tube section 37 to fix the outer tube section 19 with respect to the inner tube section 20. Note that the clamping assembly 50 is threaded to an annular boss 51 fixed to the outer tube section 42.

The invention claimed is:

1. An extendable and retractable wrench having two jaws relatively movable to clamp and turn a workpiece, comprising: an extendable and retractable handle assembly for the wrench including an outer tube assembly and an inner tube assembly slidably connected together with one of the assemblies connected to the wrench, said wrench having jaws being moveable relative to one another in the range of ½" to at least 2" to loosen and tighten clean-out plugs, said outer tube assembly and inner tube assembly each having separable portions at a common plane to divide each tube assembly into two sub-assemblies to further reduce the length of the handle assembly.

2. An extendable and retractable wrench as defined in claim 1, wherein an intermediate tube is fixed to one of the inner and outer tube assemblies to reinforce the inner and outer tube assemblies as they extend and retract relative to one another.

3. An extendable and retractable wrench as defined in claim 1, wherein there is a releasable connection between the inner and outer tubes to reduce the length of the handle assembly when the inner and outer tubes are in their retracted positions.

4. An extendable and retractable wrench having two jaws relatively moveable to clamp and turn a workpiece, comprising: an extendable and retractable handle assembly for the wrench including outer tube assembly and an inner tube assembly slidably connected together with one of the assemblies connected to the wrench, wherein there is a releasable connection in one of the tube assemblies to divide the one tube section into at least two sub-assemblies to reduce the length of the handle assembly when the inner and outer tube assemblies are in their retracted positions.

5. An extendable and retractable wrench as defined in claim 4, wherein an intermediate tube is fixed to one of the inner and outer tube assemblies to reinforce the inner and outer tube assemblies as they extend and retract relative to one another.

6. An extendable and retractable wrench having two jaws relatively moveable to clamp and turn a workpiece, comprising: a wrench having a pair of serrated pipe wrench jaws adapted to rotate a nut in a sewer pipe clean-out plug, a handle assembly for the wrench including an outer tube assembly, an intermediate tube member fixed to outer tube assembly, and an inner tube assembly, a clamp for fixing the relative positions of the outer tube assembly and the inner tube assembly, said intermediate tube member reinforcing the handle assembly, and a releasable connector in the outer tube assembly into two separable sub-sections for reducing the length of the handle assembly.

7. An extendable and retractable wrench as defined in claim 6, wherein said releasable connector includes a threaded sleeve between the first and second sub-sections of the outer tube member, and a threaded releasable stepped sleeve between the first and second sub-sections of the inner tube assembly.

8. An extendable and retractable wrench as defined in claim 7, wherein the threaded releasable sleeves are generally axially aligned along the handle assembly.

* * * * *